United States Patent [19]

Ozols

[11] Patent Number: 5,054,221

[45] Date of Patent: Oct. 8, 1991

[54] SHOTGUN WITH INTERCHANGEABLE MAGAZINE

[76] Inventor: Peter D. Ozols, 6 Fairmead Rd., Darien, Conn. 06820

[21] Appl. No.: 493,881

[22] Filed: Mar. 15, 1990

[51] Int. Cl.[5] ..... F41A 9/72

[52] U.S. Cl. ..... 42/17; 42/87

[58] Field of Search ..... 42/87, 88, 17

[56] References Cited

U.S. PATENT DOCUMENTS

| | | | |
|---|---|---|---|
| 391,811 | 10/1888 | Mixter . | |
| 869,484 | 10/1907 | Drake . | |
| 1,073,348 | 9/1913 | Hoagland . | |
| 1,834,410 | 12/1931 | Loomis | 42/17 |
| 1,874,408 | 8/1932 | Zichy . | |
| 2,023,929 | 12/1935 | Loomis | 42/17 |
| 2,472,678 | 6/1949 | Pickron | 42/87 |
| 2,773,325 | 12/1956 | Hill | 42/50 |
| 2,882,635 | 4/1959 | Hill | 42/17 |
| 3,373,520 | 3/1968 | Into | 42/49 |
| 3,399,481 | 9/1968 | Giorgini | 42/87 |
| 3,808,723 | 5/1974 | Erixon | 42/6 |
| 3,986,286 | 10/1976 | Stangel | 42/87 |
| 4,509,284 | 4/1985 | Naber | 42/87 |
| 4,756,110 | 7/1988 | Beltron | 42/87 |

OTHER PUBLICATIONS

The 1987 Annual Guns & Ammo, p. 203.

The Shotgun News-Hastings-Nebraska, dated Jun. 1, 1989, p. 29.

The Shotgun News-Hastings-Nebraska, dated Aug. 10, 1989, p. 30.

The Shotgun News-Hastings-Nebraska, dated Aug. 1, 1989, p. 95.

The Shotgun News-Hastings-Nebraska, dated Aug. 1, 1989, p. 65.

*Primary Examiner*—Michael J. Carone

*Attorney, Agent, or Firm*—Kenyon & Kenyon

[57] ABSTRACT

A shotgun has a receiver with a trigger coupled to the receiver for firing the shotgun, and a barrel mounted on one end to the receiver for firing shells from the shotgun. A bolt is mounted to the receiver and located adjacent to the barrel for feeding shells into the barrel. An interchangeable magazine has a substantially cylindrical tubular portion dimensioned to receive shotgun shells in an end to end relationship therein. The magazine is removeably attachable to the shotgun for feeding the shells in the magazine into the barrel, and for subsequently removing the magazine from the shotgun. Therefore, when the magazine is emptied, it can be removed from the shotgun and replaced with another preloaded magazine.

25 Claims, 5 Drawing Sheets

SHOTGUN WITH INTERCHANGEABLE MAGAZINE

FIELD OF THE INVENTION

The present invention relates to shotguns and, in particular, to shotguns that can be rapidly loaded with ammunition.

BACKGROUND INFORMATION

Under many circumstances it would be desirable to have a shotgun that could rapidly fire rounds of ammunition and be rapidly loaded with ammunition between rounds. For example, in police work and military applications, it is often necessary for the user's survival to be able to rapidly load a shotgun between rounds. In some sporting events, like skeet shooting, it would also be desirable to be able to rapidly reload and fire a shotgun. Although rapid firing and reloading capabilities have been achieved with some small firearms, such as assault rifles and pistols, they have not yet been satisfactorily achieved with shotguns Known semi-automatic shotguns, such as pump-action shotguns, typically have a fixed, tubular-shaped magazine mounted below the barrel, wherein the shells or cartridges are loaded individually into the magazine. A fixed magazine typically holds about five shells. After all of the shells are fired, the next round of shells are loaded one at a time into the fixed magazine. This is a time consuming process, and frequently too time consuming to make shotguns a practical alternative to other small firearms in certain police work and military applications.

It is an object of the present invention, therefore, to overcome the problems and disadvantages in rapidly loading rounds of ammunition into a shotgun.

SUMMARY OF THE INVENTION

The present invention is directed to a shotgun comprising a barrel for firing shells therethrough. The shotgun further comprises an interchangeable magazine including a substantially cylindrical, tubular portion, which is adapted to receive therein a plurality of shells in an end to end relationship. The magazine is removably coupled to the barrel to feed the shells to be fired therethrough. Once all of the shells in the magazine are spent, the magazine can be removed from the shotgun and replaced by another preloaded magazine.

One shotgun of the present invention further comprises a receiver coupled to the barrel, and a first magazine mount coupled to the barrel and adapted to receive one end of the magazine. A second magazine mount is coupled to the receiver and adapted to receive the other end of the magazine.

The tubular portion of the magazine defines an open end and a closed end. A first spring is seated on the closed end to spring load the shells within the tubular portion. The first spring pushes the shells through the open end of the tubular portion to feed the shells into the receiver, and to in turn fire the shells through the barrel.

In one shotgun of the present invention, the magazine further comprises a mounting member coupled to the closed end of the tubular portion. The mounting member is removeably engageable with first magazine mount. The second magazine mount defines a first aperture extending therethrough. The first aperture is adapted to receive the open end of the tubular portion.

When the magazine is mounted to the shotgun, the shells loaded in the magazine are fed through the open end of the tubular portion and into the receiver to be fired.

In one shotgun of the present invention, the closed end of the tubular portion defines a second aperture extending therethrough. The second aperture is dimensioned to receive the mounting member therethrough. A second spring is seated between the mounting member and the closed end of the tubular portion. The mounting member is thus spring loaded against the closed end of the tubular portion to facilitate mounting the magazine to the shotgun.

In another shotgun of the present invention, the mounting member defines a rod portion. The rod portion is received through the second aperture and the second spring. The rod portion is movable through the second aperture to facilitate mounting the magazine to the shotgun. The mounting member further includes a flange coupled to one end of the rod portion. The flange defines a first recess therein. The first magazine mount defines at least one mounting surface dimensioned to be received within the first recess to engage the mounting member with the first mount, and thus mount the magazine to the shotgun.

One advantage of the present invention is that the magazine can be easily removed from the shotgun. A user can maintain several preloaded magazines. After one preloaded magazine is emptied, that magazine can be rapidly removed from the shotgun and another preloaded magazine can be rapidly mounted on the shotgun to fire another round of shells. The shotgun can therefore be rapidly reloaded between rounds and does not have to be reloaded with shells one at a time as with most prior art shotguns. Another advantage of the present invention, is that because the removeable magazine has a substantially tubular shape, known pump-action shotguns can be retrofitted to embody the present invention.

Other advantages of the apparatus of the present invention will become apparent in view of the following detailed description and drawings taken in connection therewith.

DETAILED DESCRIPTION

Figure 1:
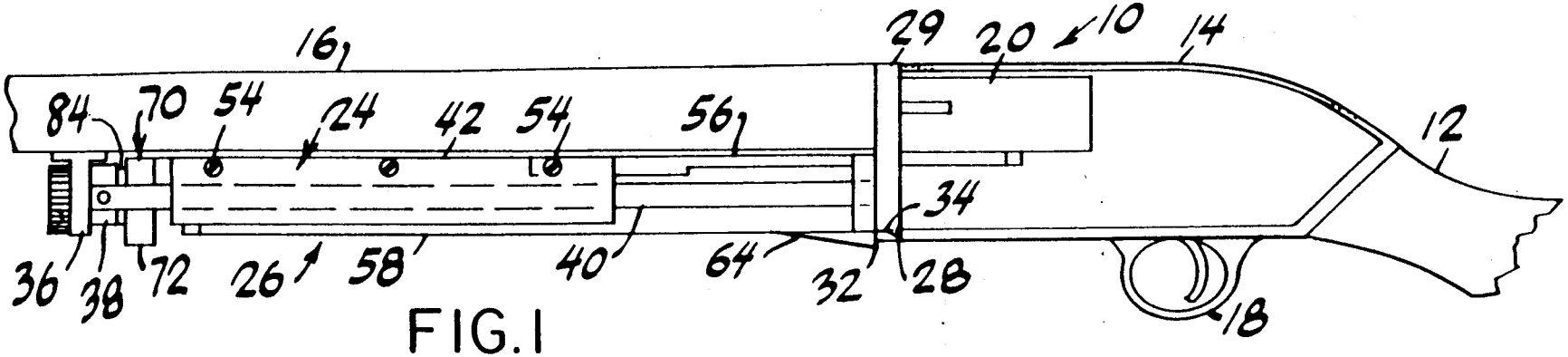
FIG. 1 is a partial, side plan view in partial cross-section of a shotgun embodying the present invention.

In FIG. 1, a pump-action shotgun embodying the present invention is indicated generally by the reference numeral 10. Although the present invention will be hereinafter described with reference to a pump-action shotgun, it will become apparent to those skilled in the art that it may be equally employed in other types of semi-automatic shotguns. The shotgun 10 comprises a stock 12, a receiver 14, and a barrel 16. The receiver 14 is of a type known to those skilled in the art, and includes a trigger 18, and a bolt, indicated generally as 20, for receiving the shells to be fired.

Figure 2A:
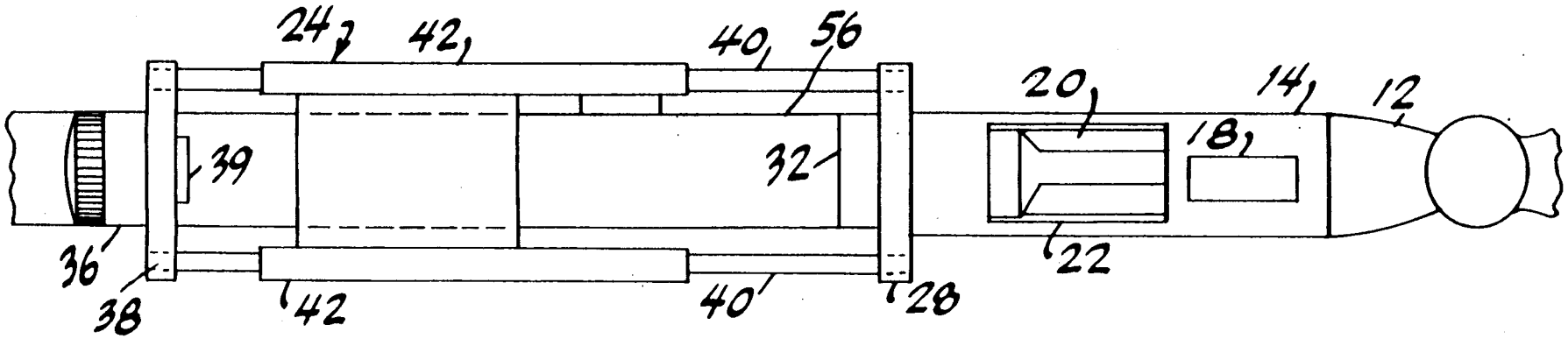
FIG. 2A is a bottom plan view of the shotgun of FIG. 1.
Figure 2B:
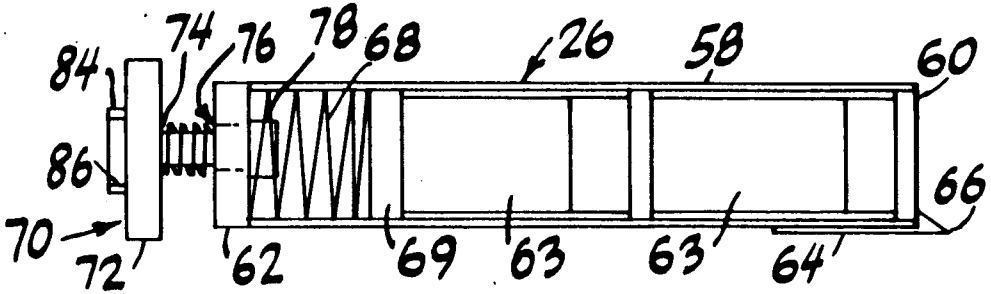
FIG. 2B is a cross-sectional view of the interchangeable magazine removed from the shotgun.

The barrel 16 defines a chamber (not shown) in the fixed end thereof to receive the shells from the bolt 20. The receiver 14 defines a loading port 22 extending through a bottom wall thereof, and located below the bolt 20, as shown in FIG. 2. Shells can be manually loaded one at a time through the loading port 22 and into the bolt 20, if the user does not use the interchangeable magazine, as described below.

Figure 3:
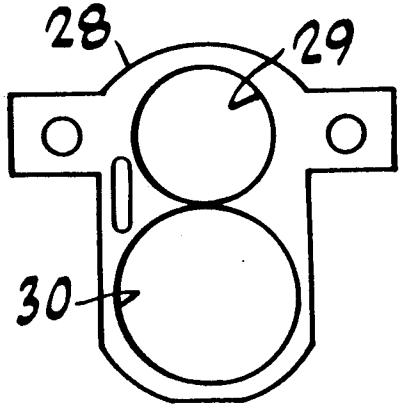
FIG. 3 is a front plan view of the rear mount of the shotgun of FIG. 1.

The shotgun 10 further includes a forearm assembly, indicated generally as 24, and an interchangeable magazine, indicated generally as 26. The forearm assembly 24 includes a rear mount 28 mounted to the front end of the receiver 14. The rear mount 28, illustrated separately in FIG. 3, defines an opening 29 extending through an upper portion thereof, which is dimensioned to receive one end of the barrel 16. The barrel 16 is mounted through the opening 29 adjacent to the bolt 20, as shown in FIG. 1.

The lower end of the rear mount 28 defines an opening 30 extending therethrough, which is dimensioned to receive a gland nut 32. The gland nut 32 defines an opening 34 extending therethrough, illustrated in phantom in FIGS. 1 and 2. The opening 34 is dimensioned to permit shells to pass therethrough from the magazine 26 into the bolt 20, as described further below. The gland nut 32 is threadedly engaged to the receiver 14, to secure the rear mount 28 to the receiver. The opening 34 is also dimensioned to receive one end of the interchangeable magazine 26 to mount the magazine to the shotgun 10, as described further below.

A front mount 36 is mounted to the bottom side of the barrel 16 and spaced apart from the rear mount 28 in the axial direction of the barrel. The front mount 36 comprises a mounting plate 38 on its side facing the receiver 14. As shown in FIG. 2, a cylindrical nub 39 is mounted to the plate 38, to mount the magazine 26 to the shotgun 10, as described further below. A pair of slide rails 40 are each mounted on one end to opposite sides of the mounting plate 38, respectively, and are each mounted on the other end to opposite sides of the rear mount 28, respectively. The slide rails 40 thus extend between the mounting plate 38 and rear mount 28 on either side of the barrel 16.

Figure 5:
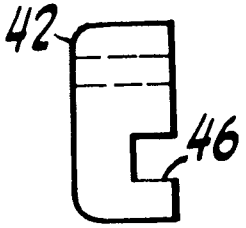
FIG. 5 is an end plan view of the forearm of FIG. 4.
Figure 4:
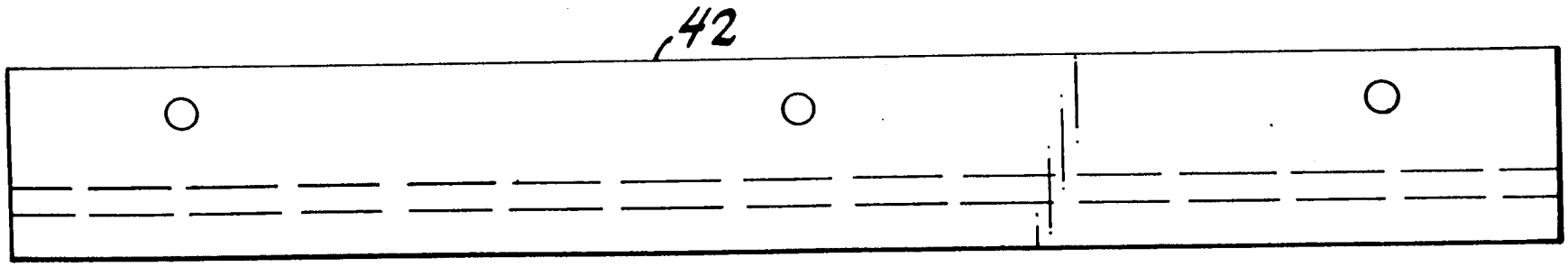
FIG. 4 is a side plan view of a typical forearm of the shotgun of FIG. 1.

Two forearms 42 are each mounted to either side of a forearm support 44. The forearms 42 are identical, and a typical forearm is illustrated separately in FIGS. 4 and 5. Each forearm 42 defines a channel 46 in one side thereof, extending from one end of the forearm to the other end in its lengthwise direction. Each channel 46 is dimensioned to receive a respective slide rail 40, so that the forearms 42 and the forearm support 44 can slide over the rails 40.

Figure 6:
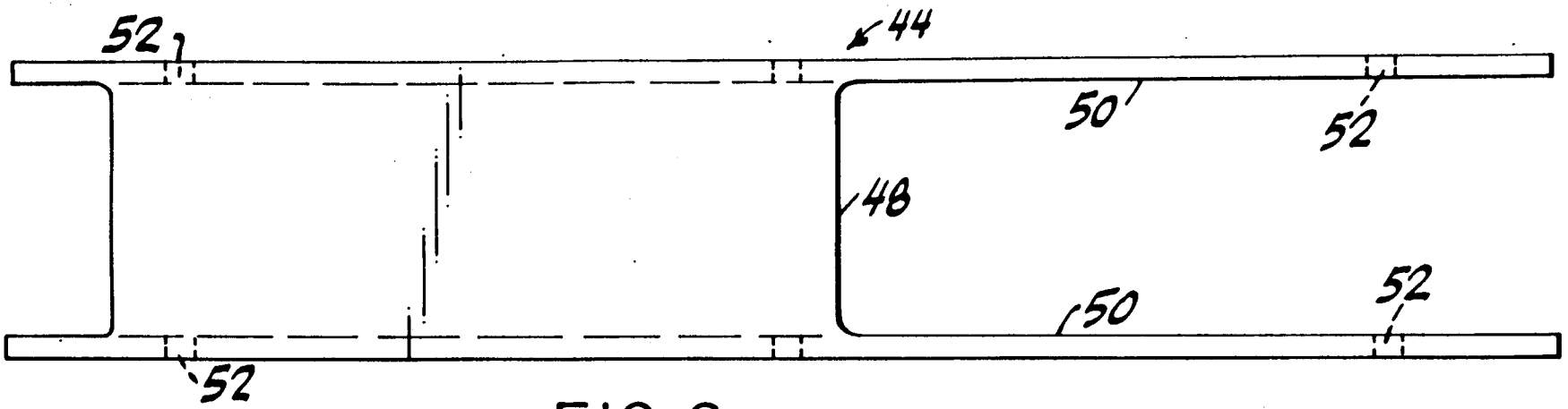
FIG. 6 is a top plan view of the forearm support of the shotgun of FIG. 1.
Figure 7:
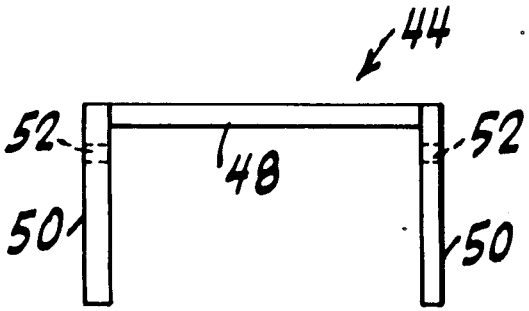
FIG. 7 is an end plan view of the forearm support of FIG. 6.

The forearm support 44 is shown in further detail in FIGS. 6 and 7, and includes a flat web portion 48 and two legs 50 extending downwardly from either side thereof. Each leg 50 is located in a plane substantially perpendicular to the plane of the web portion 48. The forearm support 44 thus has a substantially U-shaped cross-sectional configuration. Each of the legs 50 defines a plurality of holes extending therethrough, shown typically as 52, for mounting a forearm 42 thereto. The forearms 42 are mounted to the legs 50 by several fasteners, shown typically as 54 in FIG. 1, that extend through the holes 52. The forearms 42 are preferably made of a rigid plastic material having a low coefficient of friction, such as Teflon TM, at least in the surface areas of the channels 46. The forearms 42 can therefore slide relatively easily over the slide rails 40.

An operating rod 56 is mounted on one end to the bolt 20 and on the other end to an inside surface of a forearm 42, as shown in FIGS. 1 and 2. When the forearms 42 are mounted on the slide rails 40, the forearm support 44 is positioned immediately below the barrel 16. The operating rod 56 is coupled to the bolt 20 to actuate the bolt, for discharging spent shells from the chamber and loading new shells to be fired.

The bolt 20 is opened to discharge a spent shell and receive a new shell by sliding the forearms 42 back toward the receiver 14 which, in turn, drives the operating rod 56 in that direction. Then, by sliding the forearms 42 away from the receiver 14, the operating rod 56 is pushed to close the bolt 20, and thus chamber the shell to be fired. The shotgun 10 is referred to as a pump-action shotgun because of the sliding or pumping action of the forearms 42 necessary to fire the gun.

In FIG. 2, the interchangeable magazine 26 is shown removed from the shotgun 10. The magazine 26 comprises a cylindrical tube 58 having an open end 60 and a closed end 62. The inner diameter of the tube 58 is dimensioned to receive shotgun shells or cartridges, shown typically as 63, in an end to end relationship therein. A shell retaining clip 64 is mounted on one end to the tube 58, and extends in the axial direction thereof beyond its open end 60. The free end 66 of the clip 64 is bent inwardly toward the axial center of the tube 58, as shown in FIG. 2, to retain the shells 63 within the tube.

A shell loading spring 68 is fitted inside the tube 58 and seated on one end against the closed end 62 of the tube. A shell follower 69 is fitted inside the tube 58, and is sufficiently elongated so that it can slide freely inside the tube. The shell follower 69 is seated between the shell loading spring 68 and the first shell 63, thus supporting the spring loaded shells within the tube.

The magazine 26 is loaded by inserting the shells 63 into the tube 58 in an end to end relationship, as illustrated in FIG. 2. Although the tube 58 is shown loaded with only two shells 63, it is preferably dimensioned to fit about five shells depending on the length of each shell. Depending also upon the length of the barrel 16, the tube 58 can be dimensioned to hold up to 9 or 10 shells. When a shell is inserted into the open end 60, the free end 66 of the retaining clip 64 is flexed outwardly by the shell, thus permitting the shell to be pushed into the tube. Then, after the shells are loaded into the tube 58, the hooked end 66 of the clip 64 springs back into its position over the open end 60 of the tube. The shell loading spring 68 in turn pushes the loaded shells 63 toward the open end 60. The last shell 63 is therefore pressed against the hooked end 66 of the retaining clip 64, as shown in FIG. 2. The shells 63 are therefore retained within the tube 58 when the magazine 26 is not mounted to the shotgun 10. The shells 63 ordinarily cannot be released from the magazine unless the free end 66 of the retaining clip 64 is moved away from the open end 60 of the tube.

The magazine 26 further comprises a magazine catch, indicated generally as 70. The magazine catch 70 comprises a disk-shaped base portion 72, and a rod portion 74 concentrically mounted on one end thereof. The rod portion 74 is fitted through an aperture 76 extending through the closed end 62 of the tube 58. The free end of the rod portion 74 is threadedly engaged with a lock nut 78 on the inside surface of the closed end 62, to mount the magazine catch 70 to the tube.

A catch spring 80 is fitted over the rod portion 74, and seated between the base portion 72 and the closed end 62 of the tube. The magazine catch 70 is thus spring loaded against the closed end 62 of the tube. The magazine catch 70 further comprises an annular flange 84 concentrically mounted to the base portion 72 on its side opposite the rod portion 74. The annular flange 84 defines a circular opening 86 extending therethrough and terminating on the base portion 72 (indicated in phantom). The opening 86 is dimensioned to receive the cylindrical nub 39 when mounting the magazine 26 to the shotgun 10.

One advantage of the shotgun 10 of the present invention, is that the interchangeable magazine 26 is removeably mounted to the shotgun, so that it can be preloaded with shells and then rapidly mounted to the shotgun. After the round of shells is spent, the magazine can be rapidly removed from the shotgun 10 and replaced with another preloaded magazine 26 to fire another round of shells, as hereinafter described.

In operating the shotgun 10, the preloaded magazine 26 is mounted to the shotgun by inserting the open end 60 of the tube 58, into the opening 34 of the gland nut 32. The other end of the tube 58 is then pivoted upwardly so that the annular flange 84 engages the nub 39 on the front mount 36. The catch spring 80 biases the annular flange 84 against the nub 39. The magazine catch 70 therefore catches the nub 39 and, accordingly, secures the magazine 26 to the shotgun 10. As shown in FIG. 1, when the magazine 26 is mounted to the shotgun 10, the retaining clip 64 is flexed outwardly against the gland nut 32. The shell loading spring 68 pushes the shells 63 through the opening 34 and into the bolt 20 to be fired.

After all of the shells 63 are fired, the magazine 26 can be quickly removed from the shotgun 10 by pulling the magazine catch 70, or closed end 62 of the tube 58, downwardly and away from the front mount 36. The magazine catch 70 disengages the nub 39 when a downward force is applied, so that the magazine 26 can be rapidly removed from the shotgun 10. Another preloaded magazine 26 can then be rapidly mounted onto the shotgun 10 in the same manner as described above to fire another round of shells.

Therefore, unlike known shotguns having fixed tubular magazines wherein a round of shells must be loaded one after the other into the magazine, a shotgun embodying the present invention can be reloading by quickly removing the empty magazine and replacing it with another preloaded magazine. As a result, a user can rapidly reload and fire the shotgun at a substantially faster rate than with known shotguns having fixed tubular magazines. Ordinarily, a user might carry several preloaded magazines 26 so that the shotgun 10 can be continuously reloaded. The components of the magazine 26 can be made of relatively inexpensive materials, such as plastics, so that the empty magazines can either be reloaded or simply thrown away. For example, the tube 58 and catch 70 can be molded separately from plastic materials and produced relatively inexpensively in large quantities.

Another advantage of the present invention, as will be recognized by those skilled in the art, is that known pump-action shotguns can be retrofitted to operate in accordance with the present invention. The magazine 26 has an elongated, cylindrical shape, and is thus similar in shape to known tubular fixed magazines. Therefore, a fixed magazine can be removed, and the shotgun modified, as shown for example in FIG. 1, to mount the interchangeable magazine in place of the fixed magazine.

Yet another advantage of the present invention, is that if a user decides it is not necessary to rapidly reload by using separately preloaded magazines 26, an empty magazine 26 can be maintained on the shotgun and reloaded with shells in the same manner as with known shotguns. The shells are then simply loaded one at a time into the magazine 26 through the aperture 22 located below the bolt 20.

Figure 10:
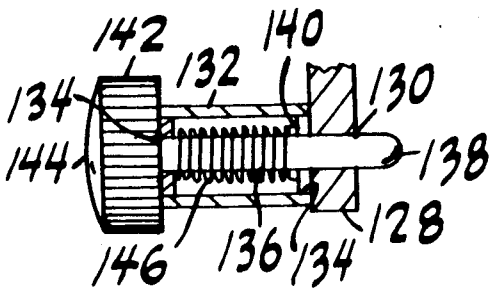
FIG. 10 is an enlarged cross-sectional view of the front mount of the shotgun of FIG. 8.
Figure 11A:
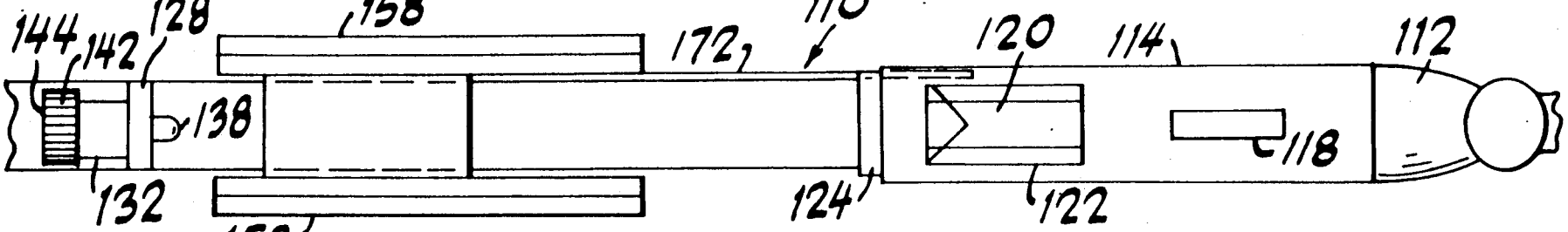
FIG. 11 is a bottom plan view of the shotgun of FIG. 8.
FIG. 11B is a cross-sectional view of the interchangeable magazine removed from the shotgun.
Figure 11B:
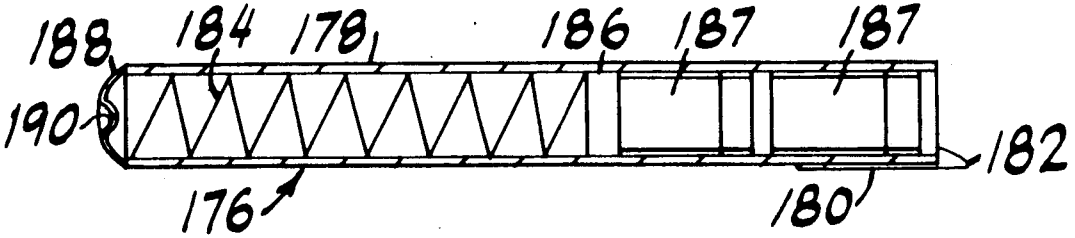

In FIGS. 8 through 11, another shotgun embodying the present invention is indicated generally by the reference numeral 110. The shotgun 110 comprises a stock 112, a receiver 114, a trigger 118, and a bolt 120. The bolt 120 has an aperture 122 extending through a bottom wall thereof, as illustrated in FIG. 11.

The shotgun 110 further comprises a rear mount 124 mounted to the receiver 114. The rear mount 124 defines a circular opening 126 extending therethrough, indicated in phantom in FIG. 8. The opening 126 is dimensioned to receive the free end of the magazine to permit shells to pass therethrough, as described further below.

A front mount 128 is mounted to the bottom side of the barrel 116 and spaced apart from the rear mount 124 in the axial direction of the barrel. The front mount 128 defines an aperture 130 extending therethrough, as shown in FIG. 10. A hollow, cylindrical pin housing 132 is mounted on one end to the front mount 128, substantially concentric with the opening 130. The pin housing 132 defines an open free end 134. A mounting pin 136 extends through the opening 130 and projects outwardly from the front mount 128. The mounting pin 136 is fitted through a pin collar 140 and fixed relative thereto. The outer diameter of the pin collar 140 is dimensioned to slideably fit within the pin housing 132. A pin cap 142 is threadedly engaged to the free end of the pin housing 132. A mounting spring 146 is seated between the pin cap 142 and the pin collar 140. The pin collar 140 is biased by the spring 146 against the front mount 128. Thus, the free end 138 of the mounting pin 136 is spring loaded, and projects outwardly from the front mount 128 in the axial direction of the barrel 116.

The shotgun 110 further comprises a forearm assembly, indicated generally as 148. The forearm assembly 148 is slideably mounted to the barrel 116, and comprises a top plate 150 and a bottom plate 152. The top plate 150 defines an elevated middle portion 154, having a substantially radial contour, and two flat side portions 156 extending outwardly from either side thereof. The top plate 154 further defines two forearm portions 158, each extending downwardly from a respective side portion 156, in a plane substantially perpendicular to the plane of the respective side portion.

Figure 9:
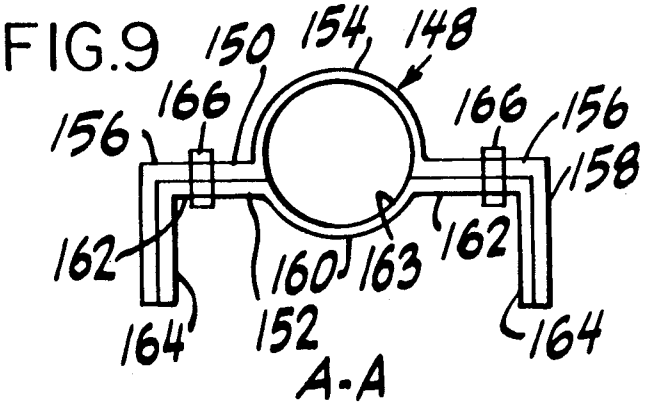
FIG. 9 is a cross-sectional view of the forearm assembly of the shotgun of FIG. 8, taken along the line A—A.

The bottom plate 152 is substantially the mirror image of the top plate 150, and thus defines an elevated portion 160, having a substantially radial contour, as shown in FIG. 9. Two flat side portions 162 are located on either side of the elevated portion 160. And two forearm portions 164 each extend downwardly from a respective side portion 162, in a plane substantially perpendicular thereto.

Figure 8:
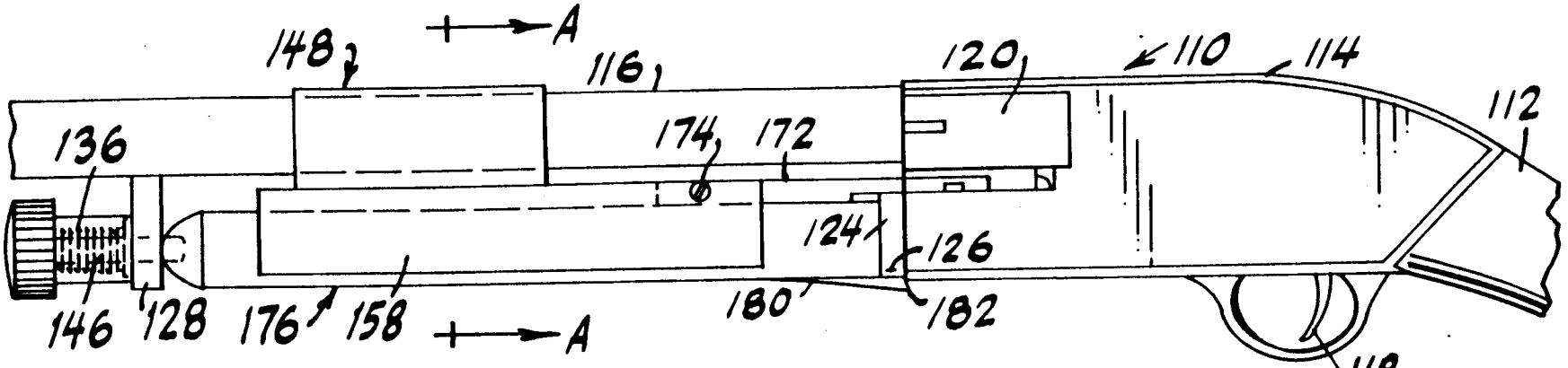
FIG. 8 is a partial, side plan view of another shotgun embodying the present invention.

As shown in FIG. 9, the top plate 154 is superimposed on the bottom plate 152, so that the elevated portions 154 and 160 define a circular opening 163 extending therethrough. The opening 163 is dimensioned to receive the barrel 116, as shown in FIGS. 8. The top plate 150 and bottom plate 152 are held together by fasteners, shown typically as 166.

An operating rod 172 is mounted on one end to the bolt 120 and on the other end to the forearm 158 by a fastener 174, as shown in FIG. 8. The bolt 120 is actuated by sliding the forearm assembly 148 over the barrel 116, to drive the operating rod 172. To open the bolt 120 and discharge a spent shell from the barrel, the forearm assembly 148 is moved back toward the receiver 114. Then, to close the bolt 120 and chamber another shell, the forearm assembly 148 is pushed back toward the front mount 128.

The shotgun 110 further comprises an interchangeable magazine, indicated generally as 176, shown removed from the shotgun 110 in FIG. 11. The interchangeable magazine 176 comprises a hollow, cylindrical tube 178. A shell retaining clip 180 is mounted on one end to the tube 178, and has a hooked free end 182 extending over the open end thereof. A shell loading spring 184 is seated inside the tube 178, and a shell follower 186 is seated against the spring 184. A magazine catch 188 is press fitted into the end of the tube 178 opposite the retaining clip 180 to close that end of the tube. The magazine catch 188 has a substantially hemispherical exterior surface, and defines in the free end thereof a radial contoured indentation 190. The indentation 190 is dimensioned to receive the free end 138 of the pin 136, to mount the magazine 176 to the shotgun 110, as described further below.

The hollow tube 178 is dimensioned to receive shotgun shells 187 in an end to end relationship therein. The shells are loaded against the shell follower 186 which, in turn, compresses the shell loading spring 184 against the magazine catch 188. The hooked free end 182 of the retaining clip 180 retains the loaded shells inside the tube when the magazine 176 is not mounted to the shotgun.

In using the shotgun 110, the interchangeable magazine 176 is mounted to the shotgun by inserting the open end of the tube 178 into the opening 126 in the rear mount 124. The other end of the magazine 176 is then pivoted upwardly until the magazine catch 188 engages the free end 138 of the pin 136. Because the pin 136 is spring loaded, when it is depressed by the magazine catch 188, it moves inwardly through the aperture 130 against the spring 146. However, once the indentation 190 is located over the pin 136, the spring 146 forces the pin's free end 138 into the indentation 190, thus securing the magazine 176 to the shotgun 110.

The force of the spring 146 against the collar 140 and, therefore, against the pin 136, can be adjusted by rotating the position of the cap 142 on the pin housing 132. As shown in FIG. 8, once the free end of the tube 178 is received in the opening 126, the outer surface of the rear mount 124 forces the free end 182 of the retaining clip 180 outwardly. The shells in the magazine are therefore permitted to pass through the opening 126 and into the bolt 120.

After the shells in the magazine 176 are spent, the magazine can be rapidly removed from the shotgun 110 by pushing the magazine 176 toward the front mount 128, thus depressing the pin 136 into the pin housing 132. The open end of the magazine 176 is then pulled downwardly and away from the rear mount 124 to release the magazine from the shotgun 110. Another preloaded magazine can then be rapidly mounted to the shotgun 110 in the same manner as described above, to fire another round of shells.

What is claimed is:

1. A shotgun, said shotgun comprising:

a barrel;

a first support member supported on one side of said barrel;

a second support member supported on the other side of said barrel relative to said first support member;

a forearm member supported on said first and second support members for moving relative to said support members; and a magazine including a substantially cylindrical, tubular portion for receiving a plurality of shells in an end to end relationship, said magazine being removably coupled to said barrel between said first and second support members for feeding shells to be fired through said barrel, said magazine thus being removeable from said shotgun to replace said magazine with another preloaded magazine.

2. A shotgun as defined in claim 1, said shotgun further comprising:

a receiver coupled to said barrel;

a first magazine mount supported from said barrel, said first magazine mount being adapted to receive one end of said magazine to mount said magazine to said shotgun; and a second magazine mount supported from said receiver and adapted to receive the other end of said magazine to mount said magazine to said shotgun

3. A shotgun as defined in claim 2, wherein said tubular portion of said magazine defines an open end and a closed end;

said magazine includes a first spring received within said tubular portion and seated on said closed end thereof; and said magazine further includes a retaining clip mounted on one end to said tubular portion, the free end of said retaining clip extending beyond said open end thereof to retain the shells inside said magazine when said magazine is not mounted to said shotgun.

4. A shotgun as defined in claim 3, wherein said free end of said retaining clip is hooked inwardly substantially toward the longitudinal axis of said tubular portion.

5. A shotgun comprising:

a barrel;

a receiver coupled to said barrel;

a first magazine mounted supported on said barrel;

a second magazine mount supported on said receiver and defining a first aperture;

a magazine including a substantially cylindrical, tubular portion defining a closed end and an open end for receiving a plurality of shells in an end to end relationship, said magazine further including a first spring received within said tubular portion and seated on said closed end, and a retaining clip mounted on one end to said tubular portion, the free end of said retaining clip extending beyond said open end to retain the shells inside said magazine when said magazine is not mounted to said shotgun, said magazine further including a mounting member coupled to said closed end of said tubular portion, said closed end of said tubular portion defining a second aperture for receiving said mounting member, said magazine further including a second spring seated between said mounting member and said closed end of said tubular portion to spring load said mounting member against said tubular portion, said mounting member further including a rod portion, said rod portion being received through said second spring and said second aperture and moveable through said second aperture, said mounting member thus being adapted to be spring loaded into engagement with said first magazine mount to mount one end of said magazine to said shotgun, said first aperture of said second magazine mount being adapted to receive said open end of said tubular portion to mount the other end of said magazine to said shotgun.

6. A shotgun as defined in claim 5, wherein said mounting member further includes a flange coupled to one end of said rod portion, said flange defining a first recess therein, and said first magazine mount defines at least one mounting surface dimensioned to be received within said first recess to engage said mounting member with said first mount.

7. A shotgun comprising:

a barrel;

a receiver coupled to said barrel;

a magazine including a substantially cylindrical, tubular portion defining a closed end and an open end for receiving a plurality of shells in an end to end relationship, said closed end defining an indentation, said magazine further including a first spring received within said tubular portion and seated on said closed end, and a retaining clip mounted on one end to said tubular portion, the free end of said retaining clip extending beyond said open end to retain the shells inside said magazine when said magazine is not mounted to said shotgun;

a first magazine mount supported on said barrel and including a pin member oriented so that its free end extends substantially in the axial direction of said barrel, said pin member being coupled on one end to a mounting spring, said mounting spring in turn being coupled to said first mount to spring load said pin member, said pin member being received within said indentation to mount the end of said magazine to said shotgun; and a second magazine mount supported from said receiver and adapted to receive the other end of said magazine to mount said other end to said shotgun.

8. A shotgun comprising:

a barrel;

a bolt coupled to said barrel for loading shells into said barrel to be fired therethrough;

first means coupled to said bolt for actuating said bolt;

a first mount coupled to said barrel; and an interchangeable magazine defining a substantially cylindrical surface for receiving shotgun shells in an end to end relationship, said magazine being spring biased into engagement with said first mount to removably couple said magazine to said shotgun for feeding the shells into said bolt and, in turn, into said barrel for firing through said barrel, said magazine being removable from said shotgun by pulling said magazine away from said barrel to disengage said spring-biased magazine from said first mount.

9. A shotgun is defined in claim 8 further comprising:

a second mount supported from said barrel and spaced apart from said first mount for supporting the other end of said interchangeable magazine.

10. A shotgun as defined in claim 9, wherein said interchangeable magazine defines a closed end and an open end, said open end being dimensioned to pass shells therethrough, said interchangeable magazine further including a shell loading spring seated against said closed end, said shell loading spring being deflected by the shells loaded into said interchangeable magazine.

11. A shotgun as defined in claim 8, wherein said interchangeable magazine further includes a magazine catch spring biased against said closed end, said magazine catch being adapted to be spring biased into engagement with said first mount to support said interchangeable magazine.

12. A shotgun as defined in claim 8, wherein said first mount defines a spring-biased mounting nub projecting outwardly therefrom, and said magazine catch defines a recess dimensioned to receive said mounting nub to mount said interchangeable magazine to said shotgun.

13. A shotgun as defined in claim 12, wherein said interchangeable magazine further includes a retaining clip coupled to one end thereof, the free end of said retaining clip extending beyond said open end of said magazine for retaining shells within said magazine.

14. A shotgun comprising:

a barrel;

a bolt coupled to said barrel;

first means coupled to said bolt for actuating said bolt;

an interchangeable magazine defining a substantially cylindrical surface dimensioned to receive shotgun shells in an end to end relationship, said magazine being removably coupled to said shotgun for feeding the shells into said bolt and, in turn, into said barrel;

a first mount coupled to said barrel for supporting one end of said interchangeable magazine;

a second mount coupled to said barrel and spaced apart from said first mount for supporting the other end of said interchangeable magazine;

a first slide rail coupled on one end to said first mount and coupled on the other end to said second mount;

a second slide rail coupled on one end to said first mount and coupled on the other end to said second mount, said first and second slide rails being spaced apart from each other on either side of said barrel to fit said interchangeable magazine therebetween; and a forearm support coupled to said first and second slide rails and to said first means, said forearm support being moveable relative to said first and second slide rails to move said first means and in turn actuate said bolt.

15. A shotgun as defined in claim 14, wherein said first means includes an operating rod coupled on one end to said forearm support and coupled on the other end to said bolt, said operating rod actuating said bolt in response to the movement to said forearm support relative to said first and second slide rails.

16. A shotgun comprising:

a barrel;

a receiver coupled to said barrel;

a magazine including a tubular member defining an open end and a closed end, said open end being adapted to receive shotgun shells therethrough for loading a plurality of shotguns shells in an end to end relationship;

a mounting member spring loaded against said closed end of said tubular member; and a first mount coupled to said barrel for engaging said mounting member to mount said magazine between said first mount and said receiver, said magazine being removable from said shotgun by pulling said magazine away from said barrel to disengage said spring-loaded mounting member from said first mount.

17. A shotgun as defined in claim 16, further comprising:

a retaining clip coupled to said tubular member, the free end of said retaining clip extending beyond said free end of said tubular member for retaining shells within said tubular member when said magazine is removed from said shotgun; and a first spring seated within said cylindrical surface against said closed end to spring load shells loaded within said tubular member against said retaining clip.

18. A shotgun as defined in claim 16, further comprising;

a second mount coupled to said receiver for receiving said open end of said tubular member to mount said magazine to said shotgun.

19. A shotgun as defined in claim 16, further comprising:

a first rail member supported on one side of said barrel;

a second rail member supported on the other side of said barrel relative to said first rail member to fit said magazine between said first and second rail members; and a forearm support member coupled to said first and second rail member for moving along said rail members.

20. A pump-action shotgun comprising:

a receiver;

a barrel supported on one end by the receiver;

a bolt supported by the receiver adjacent to the barrel for loading shells into the barrel to be fired therethrough;

a first magazine mount supported by the barrel and spaced away from the receiver, the first magazine mount being adapted to detachably support one end of a magazine;

a second magazine mount supported by the receiver and spaced apart from the first magazine mount, the second magazine mount being adapted to detachably support the other end of a magazine;

a first slide rail coupled on one end to the first magazine mount and coupled on the other end to the second magazine mount;

a second slide rail coupled on one end to the first magazine mount and coupled on the other end to the second magazine mount, the first and second slide rails being located on opposite sides of the barrel relative to each other;

a forearm support coupled to the first and second slide rails, the forearm support being slideable relative thereto; and an operating rod coupled on one end to the forearm support and coupled on the other end to the bolt, the bolt being actuated by sliding the forearm support relative to the slide rails.

21. A pump-action shotgun as defined in claim 20 further comprising:

a magazine defining an open end and a closed end, and a substantially cylindrical surface extending therebetween, the cylindrical surface being adapted to receive shotgun shells in an end to end relationship therein;

a loading spring seated within the cylindrical surface against the closed end thereof;

a magazine catch supported from the closed end of the magazine, the magazine catch being adapted to be detachably supported by the first mount; and a mounting spring seated between the closed end of the magazine and the magazine catch, the magazine catch thus being spring loaded against the closed end of the magazine.

22. A pump-action shotgun as defined in claim 21, wherein the second magazine mount defines an opening extending therethrough, said opening being adapted to receive the open end of the magazine to mount the magazine thereto.

23. A pump-action shotgun comprising:

a receiver;

a barrel coupled on one end to the receiver;

a bolt coupled to the receiver;

a rear magazine mount supported by the receiver and defining a first opening;

a front magazine mount supported by the barrel and spaced apart from the rear magazine mount and defining a mounting surface;

an interchangeable magazine defining an open end and a substantially cylindrical surface extending from the open end and terminating on a closed end for receiving a plurality of shotgun shells in an end to end relationship, the open end of the magazine being adapted to be received within the first opening in the rear magazine mount to mount one end of the magazine to the shotgun;

a magazine catch coupled to the closed end of the magazine and defining a mounting recess to receive the mounting surface of the front mount to mount the other end of the magazine to the shotgun;

a first rail mounted on one end to the rear mount and mounted on the other end to the front mount;

a second rail mounted on one end to the rear mount and mounted on the other end to the front mount, the second rail being located on the other side of the barrel from the first rail to fit the magazine between the two rails;

a forearm support coupled to the first and second rails for moving relative to the rails; and an actuating rod coupled on one end to the forearm support and coupled on the other end to the bolt, the actuating rod being moveable in response to movement of the forearm support to operate the bolt.

24. A pump-action shotgun comprising:

a receiver;

a barrel coupled on one end to the receiver;

a bolt coupled to the receiver;

a rear magazine mount supported by the receiver and defining a first opening;

a front magazine mount supported by the barrel and spaced apart from the rear magazine mount and defining a mounting surface;

an interchangeable magazine defining an open end for receiving a plurality of shotgun shells in an end to end relationship, the open end being adapted to be received within the first opening in the rear magazine mount to mount one end of the magazine to the shotgun;

a mounting member coupled to the closed end of the magazine and defining amounting recess for receiving and mounting surface of the front mount to mount the other end of the magazine to the shotgun;

a forearm support defining a mounting aperture extending therethrough, the mounting aperture being adapted to receive the barrel for sliding the forearm support relative to the barrel, the forearm support including two handle members, each handle member being located on an opposite side of the barrel relative to the other to fit the interchangeable magazine between the two handle members, each handle member being adapted to be gripped to slide the forearm support relative to the barrel; and an operating rod coupled on one end to the forearm support and coupled on the other end to the bolt, the bolt being operated by sliding the forearm support relative to the barrel.

25. A pump-action shotgun as defined in claim 24, further comprising:

a mounting spring seated between the magazine catch and the closed end of the magazine, the magazine catch thus being spring loaded against the closed end of the magazine; and a loading spring seated within the substantially cylindrical surface against the closed end thereof for spring loading shotgun shells within the magazine.

* * * * *